United States Patent [19]

Hagen et al.

[11] 4,412,371

[45] Nov. 1, 1983

[54] DEVICE FOR INTRODUCING A TRAVELING YARN INTO A YARN TREATMENT CHAMBER

[75] Inventors: Gerry A. Hagen; Edward N. Donnelly, both of Anderson, S.C.

[73] Assignee: Badische Corporation, Williamsburg, Va.

[21] Appl. No.: 273,152

[22] Filed: Jun. 11, 1981

[51] Int. Cl.[3] ..... D02G 1/16

[52] U.S. Cl. ..... 28/272; 28/275; 264/168

[58] Field of Search ..... 28/272, 275; 264/168

[56] References Cited

U.S. PATENT DOCUMENTS

| | | | |
|---|---|---|---|
| 3,424,359 | 1/1969 | Houle et al. | 28/272 |
| 3,577,721 | 5/1971 | Schmick et al. | 28/272 |
| 3,688,957 | 9/1972 | Beddoe et al. | 28/272 |
| 3,970,231 | 7/1976 | Strutz et al. | 28/272 |
| 4,051,581 | 10/1977 | Biot et al. | 28/272 |
| 4,240,187 | 12/1980 | Hevold et al. | 28/272 |
| 4,280,260 | 7/1981 | Martin et al. | 28/272 |

FOREIGN PATENT DOCUMENTS

WO79/00956 12/1979 PCT Int'l. Appl. ..... 28/272

*Primary Examiner*—Jay H. Woo

*Attorney, Agent, or Firm*—George F. Helfrich

[57] ABSTRACT

A traveling yarn is introduced into a yarn treatment chamber, such as a texturing device, wherein essentially standard treatment temperatures are being employed, the yarn traveling at standard speeds and temperatures for the treatment process carried out in the treatment chamber. The yarn is caused to pass through, out of, and away from the yarn treatment chamber.

This is accomplished by first capturing the traveling yarn and positioning the captured traveling yarn in front of the inlet orifice of the yarn treatment chamber at a tension of 0.025 gram/dtex to 0.35 gram/dtex. Then the captured traveling yarn is cut and simultaneously directed into and through the yarn treatment chamber by means of an external propelling fluid. Finally, the treated yarn is conveyed away from the yarn treatment chamber.

3 Claims, 7 Drawing Figures

DEVICE FOR INTRODUCING A TRAVELING YARN INTO A YARN TREATMENT CHAMBER

BACKGROUND OF THE INVENTION

1. Field of the Invention

The invention relates generally to the manufacturing of textiles. More particularly, it relates to strand treatment or finishing by surface modification of a running length thereof, e.g., texturing, esp. fluid jet texturing, wherein a method and a device are presented for introducing the traveling yarn into the yarn treatment chamber.

2. Prior Art Background

In the treating or finishing of yarns by surface modification of a running length thereof, e.g., texturing, esp. fluid jet texturing, there has been a long standing need for a method and a device for introducing the traveling yarn into the yarn treatment chamber during string-up. Employed for some time has been a wire hook or loop, which is guided internally through the treatment chamber, e.g., texturing device, to engage the yarn, whereupon the hooked yarn is mechanically pulled through the treatment chamber to the exit thereof. At processing speeds employed in today's manufacturing operations, such an antiquated technique is unreliable, causes excessive yarn waste, and is a potential source of damage to the internal configuration of the treatment chamber.

3. Statement of Closest Known Prior Art

The closest prior art of which the inventors are aware is set forth below:

U.S. Pat. No. 4,051,581, Biot, et al., discloses a device for introducing a yarn into a pneumatic yarn texturing means by pushing the yarn into the texturing means. Specifically, the yarn is first positioned at a right angle across the inlet orifice of the texturing means, after which a liquid jet and a downstream yarn cutter are activated in synchronization, so that the yarn forms a loop and is propelled by the liquid jet into the texturing means. Downstream of the inlet of the texturing means the yarn must be forwarded by means of whatever fluid is employed in the texturing operation.

Although fluids are taught generally in Biot, only liquids are shown to be applicable. Moreover, special equipment is required to synchronize the action of the liquid jet and the yarn cutting means. Furthermore, the yarn is forced only a short distance into the forwarding section of the texturing means, and not completely therethrough, which would be desirable. Finally, the advantage of an inlet orifice of a specially curved configuration is strongly emphasized.

SUMMARY OF THE INVENTION

The primary object of the present invention is to provide a method and a device for introducing a traveling yarn into a yarn treatment chamber during string-up, which method and device avoid the difficulties and obviate the disadvantages presented by the prior art methods and devices discussed supra. This object is achieved by providing:

A. A process for (a) introducing a traveling yarn into a yarn treatment chamber wherein essentially standard treatment temperatures are being employed, the yarn traveling at standard speeds and temperatures for the treatment process carried out in the yarn treatment chamber, and (b) causing the yarn to pass through, out of, and away from the yarn treatment chamber, the ratio of the denier of the traveling yarn to the area of the inlet orifice of the treatment chamber being not greater than 1200 dtex/mm$^2$; the process comprising the following sequential procedural steps:

(1) capturing the traveling yarn and positioning the captured traveling yarn in front of the inlet orifice of the yarn treatment chamber at a tension of 0.025 gram/dtex to 0.35 gram/dtex;

(2) cutting and simultaneously directing the captured traveling yarn into and through the yarn treatment chamber by means of an external propelling fluid; and (3) conveying the treated yarn away from the yarn treatment chamber.

B. A device for introducing a traveling yarn into a yarn treatment chamber and causing the yarn to pass through, out of, and away from the chamber; the device comprising:

(a) a head piece having an orifice communicating with a channel running therethrough and a means for capturing and positioning the traveling yarn in front of the yarn treatment chamber, the head piece providing alignment for the push jet recited in (b) below with respect to the traveling yarn and the yarn treatment chamber;

(b) a push jet having a mating surface for engaging the head piece, the push jet being provided with means for directing gas into the head piece;

(c) means for positioning the traveling yarn across the orifice of the head piece;

(d) means for aligning the push jet so that it is contiguous with the orifice of the head piece;

(e) a yarn cutting means located downstream from the head piece with respect to the direction of yarn travel;

(f) means for common activation of the push jet and the yarn cutting means; and (g) means for conveying the yarn away from the yarn treatment chamber after it has passed therethrough.

Advantages of the instant method and device which are worthy of particular mention are:

(1) The instant operation is relatively insensitive to yarn tension, guiding adjustments, and cleanliness of the yarn treatment chamber;

(2) The instant operation transfers the yarn through the entire yarn treatment chamber, such as a fluid jet texturing device;

(3) No adjustable or specially curved inlet orifices are required;

(4) No elaborate equipment for synchronization of fluid jet and yarn cutter is required; they may be pneumatically activated simultaneously;

(5) Fluids such as air may be employed effectively;

(6) The instant operation affords a high thread-in efficiency, while allowing maximum treatment (e.g., texturing) flexibility and significantly reduced string-up waste.

BRIEF DESCRIPTION OF THE DRAWING

For a more complete understanding of the present invention, including its primary object and benefits, reference should be made to the Detailed Description of the Preferred Embodiments, which is set forth below. This detailed description should be read together with the accompanying drawing, wherein FIGS. 1–6 schematically depict the operation of preferred embodiments of the method and device according to the present invention in sequential steps.

DETAILED DESCRIPTION OF THE PREFERRED EMBODIMENTS

Figure 1:
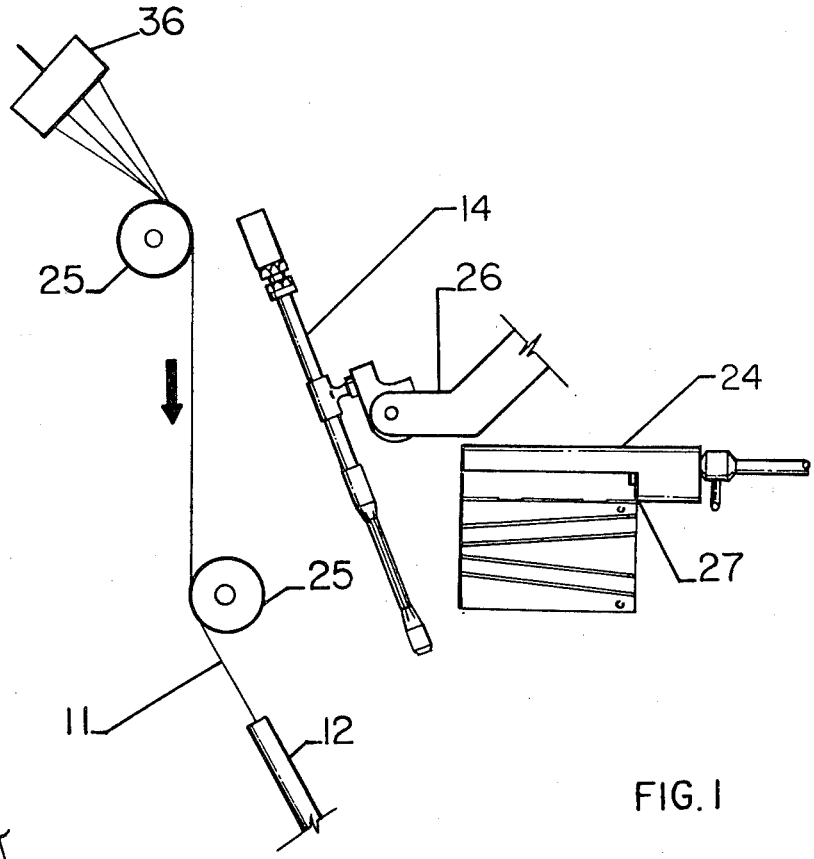
Figure 2:
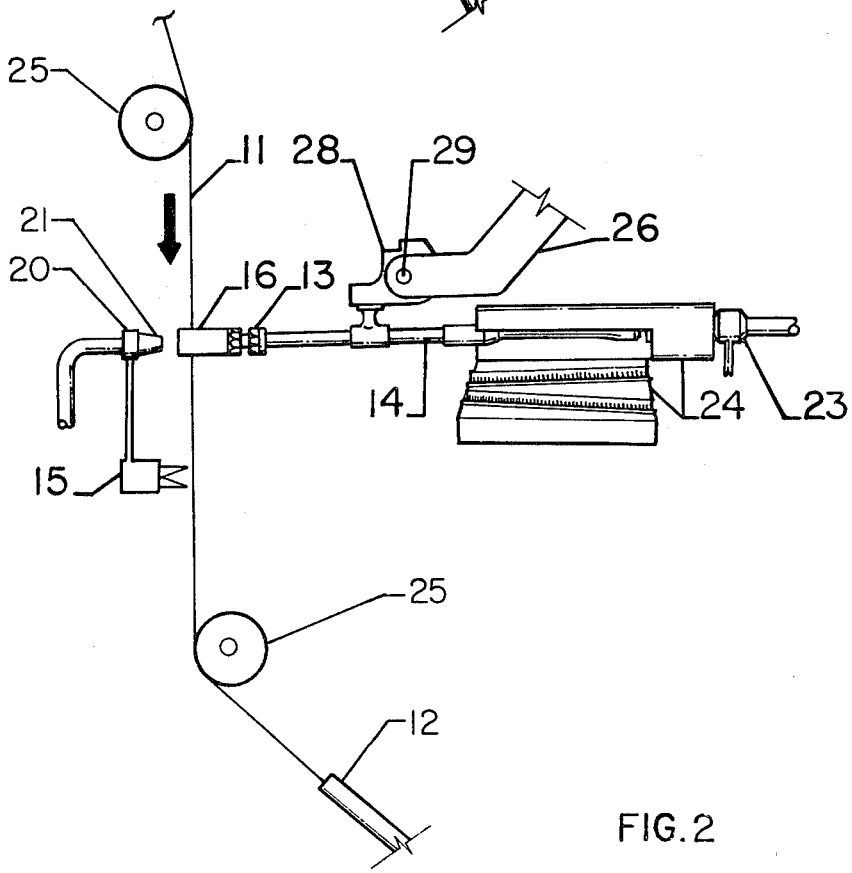

Referring now to the drawing, there is shown in FIG. 1 a multifilament yarn (11), which having been spun through spinnerette (36) and cooled, has been passed around guide rollers (25) in the direction shown by the arrow, and has been captured by yarn catching means (12), which is advantageously a suction tube or suction gun well-known to those of skill in the art. Yarn treatment chamber (14), which is shown here as a fluid jet texturing device such as those specified in U.S. Pat. Nos. 3,714,686 and 3,908,248, is located in a first or operating position prior to string-up. This treatment chamber is mounted on support arm (26) for rotational movement to a second or string-up position, which is seen in FIG. 2. The multifilament yarn (11) is advantageously a melt spun yarn (e.g., a polyamide such as nylon-6, which is produced by standard techniques such as those described in detail in U.S. Pat. Nos. 3,093,445 and 3,104,419), although wet spun and dry spun yarns produced according to standard techniques may also be employed with success. As is understood by those of skill in the art, standard spin finishes are generally applied to the solidified multifilament strands prior to a yarn treatment operation such as the texturing operation shown. Moreover, the texturing operation as shown in the drawing is often combined with other operations to produce an integrated draw-texturing or spin-draw-texturing procedure, for example. In this regard, U.S. Pat. Nos. 3,714,686; 3,908,248; and 4,096,226 are of instructional value to those of skill in the art. Devices such as those described in U.S. Pat. No. 3,893,412 are very useful in ensuring that spin finishes are applied uniformly over the width and along the length of the multifilament yarn. In addition to texturing, the present invention is applicable to yarn treatments such as interlacing, and the like. The method and device of the present invention, when employed with a fluid jet texturing device as yarn treatment chamber (14), are advantageously put into practice in combination with a thread-in chamber (24), which is shown in FIG. 1 to consist of two major sections joined by means of hinge (27). The operation of this expedient will be discussed in more detail hereinafter.

Figure 7:
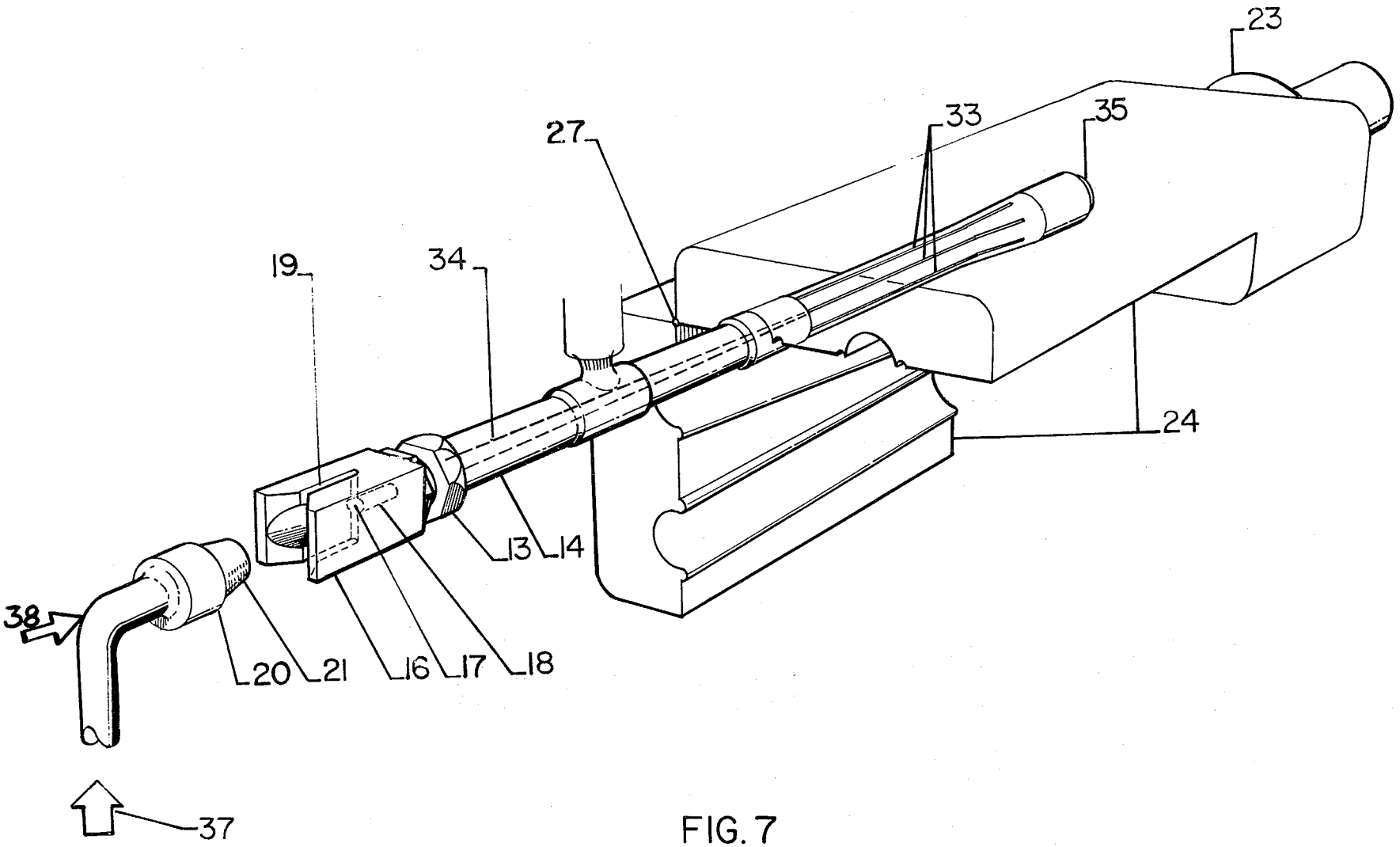
FIG. 7 is a perspective view detailing a preferred embodiment of the device according to the present invention.

FIG. 2 shows yarn treatment chamber (14) in its second or string-up position, mounting bracket (28) having been rotated on pivot pin (29), which is secured to support arm (26). Under such conditions, the downstream end of treatment chamber (14) is positioned within thread-in chamber (24), when the latter is employed. Under such conditions, head piece (16), which is secured to the upstream end of treatment chamber (14), is in position to capture traveling yarn (11) and position traveling yarn (11) in front of inlet orifice (13) of yarn treatment chamber (14). In this regard, it must be pointed out that the present invention is operable only when the ratio of the denier of the traveling yarn (11) to the area of the inlet orifice (13) of the treatment chamber (14) is not greater than 1200 dtex/mm$^2$. Under these conditions, yarn (11) can travel at standard speeds and temperatures for the treatment process which is being carried out in treatment chamber (14). A particularly preferred mechanism by which head piece (16) captures and positions traveling yarn (11) in front of inlet orifice (13) of treatment chamber (14) is shown in FIG. 7 and will be discussed infra. In any event, it is essential in the process of the present invention that the captured traveling yarn be positioned in front of the inlet orifice of the yarn treatment chamber at a tension of from 0.025 gram/dtex to 0.35 gram/dtex. Beyond these limits the process is not operable.

Figure 3:
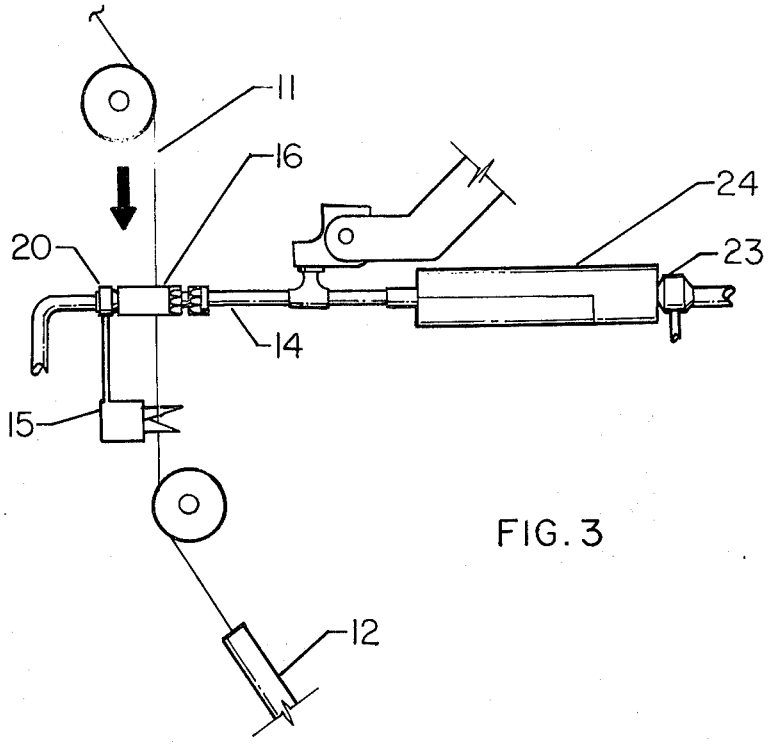
Figure 4:
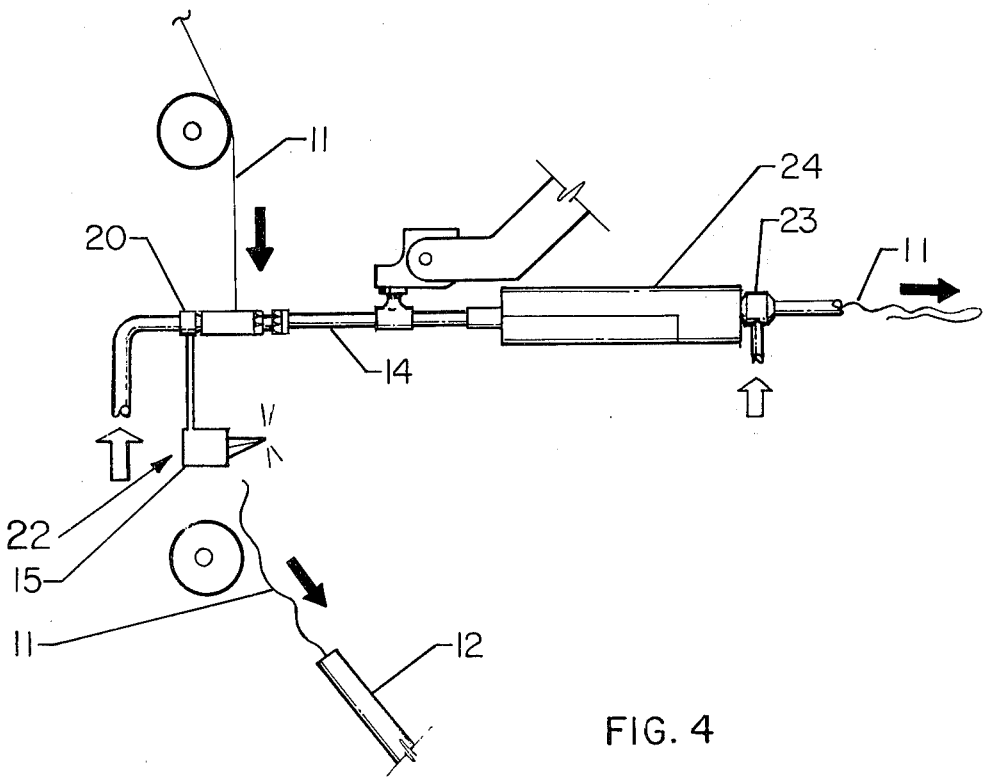

After being captured and positioned, traveling yarn (11) is cut and simultaneously directed into and through yarn treatment chamber (14) by means of an external propelling fluid. This step is illustrated with reference to FIGS. 2, 3 and 4. Sequentially shown is the following: push jet (20), which has a mating surface (21) for engaging head piece (16), is first moved into engagement with head piece (16), whereupon yarn cutter (15) is moved into proximity with traveling yarn (11), and thread-in chamber (24) is closed around the downstream end of yarn treatment chamber (14), effecting a hermetic seal. The employment of thread-in chamber (24), although not of absolute essence, provides a preferred embodiment of the present inventive process. In the preferred embodiment shown, the cutting and simultaneous directing of the captured yarn (11) into and through yarn treatment chamber (14) are effected by means of common activation loop (22), through which fluid, esp. a gas such as air is forced, as shown by the white arrow at loop (22) in FIG. 4. Traveling yarn (11) downstream of cutter (15) is taken up by suction into yarn catching means (12), and traveling yarn (11) upstream of cutter (15) is forced by means of the propelling fluid into and through yarn treatment chamber (14), whence it is conveyed away therefrom. Thread-in chamber (24), in cooperation with aspirator (23)—into which a fluid, esp. a gas such as air is forced as shown by the white arrow at aspirator (23)—effects an underpressure at the inlet orifice (13) of yarn treatment chamber (14), and assists in conveying yarn (11) away from treatment chamber (14). This is highly advantageous.

When the propelling fluid is a gas, yarn (11) may travel at speeds of 1000 meters/minute and greater, with highly beneficial results in the practice of the present invention. Indeed, yarn treatment chambers which are texturing devices with lengths of up to about 500 mm are employed with success, at standard operating temperatures. Of course, the instant process may be employed to introduce a traveling yarn into a yarn treatment chamber which is temporarily operating below the standard operating temperature thereof, if desired for any reason. Moreover, the instant process has achieved especially beneficial results when texturing devices are employed, the internal configuration of which is not constant along the length thereof, as seen at (34) in FIG. 7.

Figure 5:
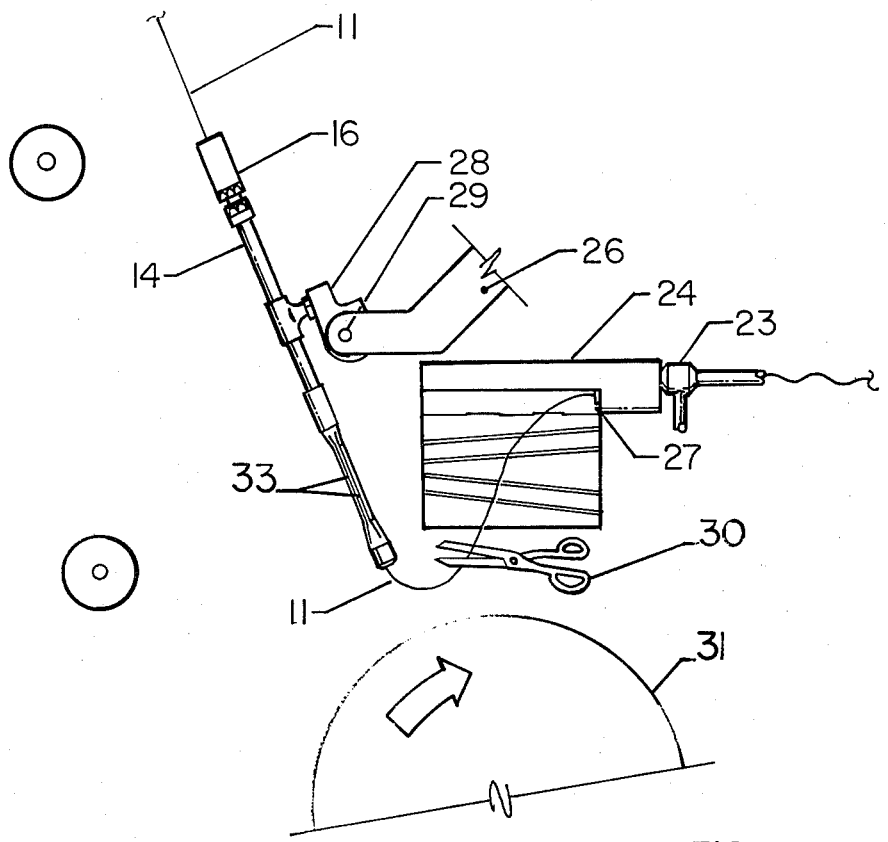
Figure 6:
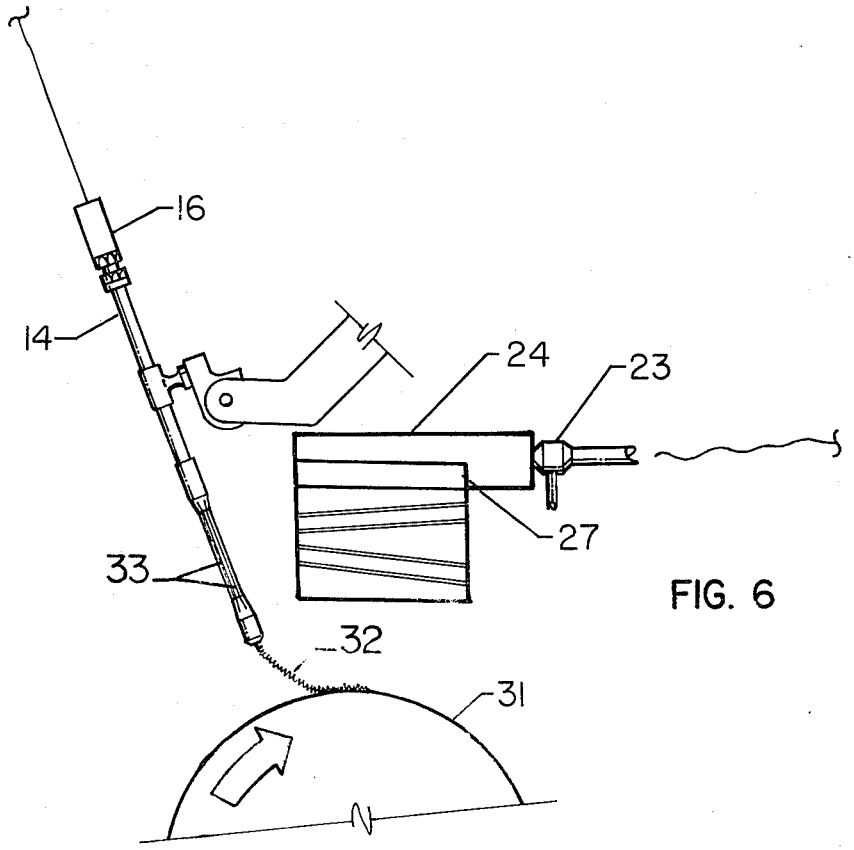

In order to further illustrate the employment of the instant process when the yarn treatment chamber (14) is a texturing device, FIGS. 5 and 6 are supplied. After traveling yarn (11) has been directed through yarn treatment chamber (14) and conveyed away therefrom, yarn treatment chamber (14) is rotated from its string-up position to its operating position, as shown in FIG. 5 (After the withdrawal of push jet (20) and the opening of thread-in chamber (24), if the latter is utilized). Cutting means, as at (30), is used to sever the traveling yarn (11), which then exits texturing device (14) in crimped form (32), and is collected upon cooling drum (31), which rotates in the direction shown by the arrow.

An especially desirable embodiment of the process according to the present invention is a continuous process for the melt spinning of filaments of a thermoplastic polymeric material through a spinnerette to produce a multifilament yarn and subsequent treatment of the yarn in a yarn treatment chamber, the ratio of the denier of the traveling yarn to the area of the inlet orifice of the yarn treatment chamber being not greater than 4200 dtex/mm$^2$. This embodiment comprises the following sequential procedural steps:

(a) reducing the flow rate of the polymeric material through the spinnerette so that the ratio of the denier of the traveling yarn to the area of the inlet orifice of the yarn treatment chamber is reduced from a maximum of 4200 dtex/mm$^2$ to a maximum of 1200 dtex/mm$^2$;

(b) capturing the multifilament yarn traveling from the spinnerette and positioning the captured yarn in front of the inlet orifice of the yarn treatment chamber at a tension of 0.025 gram/dtex to 0.35 gram/dtex;

(c) cutting and simultaneously directing the captured yarn into and through the yarn treatment chamber by means of an external propelling gas;

(d) conveying the yarn away from the yarn treatment chamber; and (e) increasing the flow rate of the polymeric material through the spinnerette so that the ratio of the denier of the traveling yarn to the area of the inlet orifice of the yarn treatment chamber is increased from a maximum of 1200 dtex/mm$^2$ to a maximum of 4200 dtex/mm$^2$.

In another aspect, the present invention is embodied in a device, which is understood by referring especially to FIG. 7, in the light of FIGS. 1–6. Provided is a device for introducing a traveling yarn (11) into a yarn treatment chamber (14) and causing the yarn to pass through, out of, and away from the chamber. The device comprises:

(a) a head piece (16) having an orifice (17) communicating with a channel (18) running therethrough and slot means (19) for capturing and positioning traveling yarn (11) in front of yarn treatment chamber (14), the head piece (16) providing alignment for push jet (20) described below with respect to traveling yarn (11) and the yarn treatment chamber (14);

(b) a push jet (20) having a mating surface (21) for engaging head piece (16), the push jet (20) being provided with means (37) for directing gas into the head piece (16);

(c) means (25) for positioning the traveling yarn across slot means (19) of head piece (16);

(d) means (38), which is either manual or standard automatic, for aligning push jet (20) so that it is contiguous with orifice (17) of head piece (16);

(e) a yarn cutting means (15) located downstream from head piece (16) with respect to the direction of yarn travel;

(f) means (22) for common activation of push jet (20) and yarn cutting means (15); and (g) means (23) and (24) for conveying yarn (11) away from yarn treatment chamber (14) after it has passed therethrough. This device is especially advantageously employed when yarn treatment chamber (14) is a fluid texturing device as shown in FIG. 7, particularly a texturing device such as those described in U.S. Pat. Nos. 3,714,686 and 3,908,248, such devices being characterized by the presence of slots (33). Under such conditions, thread-in chamber (24) is advantageously employed in cooperation with the device of the present invention. Thread-in chamber (24), which is conveniently fabricated in two sections that are hinged at (27), is used to enclose the texturing device over the slotted area thereof, so that in cooperation with aspirator (23) it may effect a decrease in pressure at the inlet (17) into the texturing device. Moreover, the device of the present invention is employed with especially beneficial results when the length of the texturing device is from 10–500 mm and when the internal configuration (34) of the texturing device is not constant along the length thereof, as seen in FIG. 7 when viewed from inlet (17) to outlet (35).

The process and device according to the present invention may be better understood by referring to the following illustrative example.

EXAMPLE

Nylon-6 chip was spun through a spinnerette such that a drawn 1565 dtex/99 strand multifilament yarn was presented to a texturing means similar to that shown in U.S. Pat. No. 3,908,248 at 2119 meters per minute. The flow rate through the spinnerettes was then automatically reduced by a ratio of 3:1 to 522 dtex. A sequence of events then took place for introducing the yarn through the hot texturing device: The texturing device was rotated into a position essentially perpendicular to the running yarn and the yarn was positioned under 80 grams tension in front of the 1.6 mm diameter inlet orifice. The movable portion of the thread-in chamber was closed about the slit nozzle and the chamber suction nozzle activated to create an underpressure of 480 torr. A push-jet with a 1.2 mm diameter orifice was mated to the head piece, the push-jet and yarn cutter being commonly activated by air at 5.5 bar. The running yarn was then simultaneously directed through the 300 mm long texturing device and carried away by the chamber suction nozzle. The push-jet was then removed. Yarn was then additionally drawn in by the texturing device using air at 7.7 bar, 8.3 normal cubic meters/hour, and 260° C.

To complete the string-up process, the thread-in chamber was opened and the texturing device rotated into its running position. The flow rate through the spinnerette was then increased to the original 1565 dtex.

Although the present invention has been described in detail with respect to certain preferred embodiments thereof, it is understood by those of skill in the art that variations and modifications in this detail may be effected without any departure from the spirit and scope of the present invention, as defined in the hereto-appended claims.

We claim:

1. A device for introducing a traveling yarn into a yarn treatment chamber and causing the yarn to pass through, out of, and away from the chamber; the device comprising:

(a) a head piece having an orifice communicating with a channel running therethrough and a means for capturing and positioning the traveling yarn in front of the yarn treatment chamber, the head piece providing alignment for the push jet recited in (b) below with respect to the traveling yarn and the yarn treatment chamber;

(b) a push jet having a mating surface for engaging the head piece, the push jet being provided with means for directing gas into the head piece;

(c) means for positioning the traveling yarn across the orifice of the head piece;

(d) means for aligning the push jet so that it is contiguous with the orifice of the head piece;

(e) a yarn cutting means located downstream from the head piece with respect to the direction of yarn travel;

(f) means for common activation of the push jet and the yarn cutting means; and (g) means for conveying the yarn away from the yarn treatment chamber after it has passed therethrough.

2. The device of claim 1, wherein the yarn treatment chamber is a fluid texturing device.

3. The device of claim 2, which additionally comprises a thread-in chamber for enclosing the texturing device so that a decrease in pressure is effected at the inlet of the texturing device.

* * * * *